US010829898B2

(12) United States Patent
Morrison

(10) Patent No.: US 10,829,898 B2
(45) Date of Patent: Nov. 10, 2020

(54) THREE-DIMENSIONAL BRIDGE DECK FINISHER

(71) Applicant: GOMACO Corporation, Ida Grove, IA (US)

(72) Inventor: Matthew Morrison, Ida Grove, IA (US)

(73) Assignee: Gomaco Corporation, Ida Grove, IA (US)

( * ) Notice: Subject to any disclaimer, the term of this patent is extended or adjusted under 35 U.S.C. 154(b) by 0 days.

(21) Appl. No.: 16/383,786

(22) Filed: Apr. 15, 2019

(65) Prior Publication Data

US 2020/0040533 A1 Feb. 6, 2020

Related U.S. Application Data

(60) Provisional application No. 62/657,554, filed on Apr. 13, 2018.

(51) Int. Cl.

| | |
|---|---|
| ***E01C 19/00*** | (2006.01) |
| ***E01C 23/01*** | (2006.01) |
| ***E01C 19/22*** | (2006.01) |

(52) U.S. Cl.

CPC ..... *E01C 23/01* (2013.01); *E01C 19/004* (2013.01); *E01C 19/22* (2013.01)

(58) Field of Classification Search

CPC ..... E01C 19/004; E01C 19/22; E01C 23/01
USPC ..... 404/72–75, 84.05–118; 14/77.1
See application file for complete search history.

(56) References Cited

U.S. PATENT DOCUMENTS

| | | | | |
|---|---|---|---|---|
| 4,744,694 | A * | 5/1988 | Leone | E01C 23/025 404/89 |
| 6,012,337 | A | 1/2000 | Hodge | |
| 6,055,486 | A * | 4/2000 | Minnich | E01C 19/407 404/115 |
| 9,670,627 | B1 | 6/2017 | Schaeding et al. | |
| 9,739,019 | B1 | 8/2017 | Godbersen | |
| 2002/0119004 | A1 | 8/2002 | Sipherd et al. | |
| 2004/0057795 | A1 * | 3/2004 | Mayfield | A63C 19/06 404/84.05 |
| 2009/0103978 | A1 | 4/2009 | Walker et al. | |
| 2010/0129152 | A1 | 5/2010 | Taylor | |

(Continued)

OTHER PUBLICATIONS

International Search Report dated Jul. 2, 2019 for PCT/US2019/027451.

*Primary Examiner* — Raymond W Addie
(74) *Attorney, Agent, or Firm* — Suiter Swantz pc llo

(57) ABSTRACT

A bridge paving machine and method for paving a 3D design without vertical profile rails includes converting a desired design into a 3D surface model to account for certain factors known to cause deviations in the paving processes and paving the 3D surface model in the expectation that factors will cause the 3D surface model to deflect into the desired design. An on-board computer system adjusts the 3D surface model in real-time to correct for on-site variables. The on-board computer system receives data from various external sensors, including deflection sensors fixed to girders in the bride structure, and paving machine-based sensors, and uses various predictive models to predict surface deflection based on the sensor data. The 3D surface model is continuously updated based on the predictive models and actual measured deflections.

18 Claims, 12 Drawing Sheets

(56) References Cited

U.S. PATENT DOCUMENTS

| | | | | |
|---|---|---|---|---|
| 2015/0275482 | A1* | 10/2015 | Hill | E02F 9/262<br>701/50 |
| 2017/0121939 | A1* | 5/2017 | Schaeding | E02F 9/2041 |
| 2017/0226708 | A1* | 8/2017 | Fujimoto | E01C 19/004 |
| 2019/0218728 | A1* | 7/2019 | Valencia | E01D 21/00 |

* cited by examiner

THREE-DIMENSIONAL BRIDGE DECK FINISHER

CROSS-REFERENCE TO RELATED APPLICATION

The present application is related to and claims the benefit of the earliest available effective filing date(s) from the following listed application(s) (the "Related Applications") (e.g., claims earliest available priority dates for other than provisional patent applications or claims benefits under 35 USC § 119(e) for provisional patent applications, for any and all parent, grandparent, great-grandparent, etc. applications of the Related Application(s)).

RELATED APPLICATIONS

For purposes of the USPTO extra-statutory requirements, the present application constitutes a regular (non-provisional) patent application of United States Provisional Patent Application entitled THREE-DIMENSIONAL BRIDGE DECK FINISHER, naming Matt Morrison as inventor, filed Apr. 13, 2018, U.S. Provisional App. No. 62/657,554.

FIELD OF THE INVENTION

Embodiments of the inventive concepts disclosed herein are directed generally toward paving and finishing machines, and more particularly to machines for paving and finishing bridge decks.

BACKGROUND

Bridge paving is one of the most technical and labor-intensive paving applications. Beams having a camber are placed such that the weight of the bridge surface will deflect the beams to a final surface. Once the structure of the bridge is in place, rails are set using standard surveying methods corresponding to the vertical profile of the pavement to be laid and finished. The paving machine is then set to the cross-section of the bridge. These conventional techniques are labor intensive and are prone to inaccurate results. Additionally, problems frequently occur when pouring complex pavement designs and transitions.

Therefore, it would be desirable to provide a system and method that cure the shortfalls of the previous approaches.

SUMMARY

In one aspect, embodiments of the inventive concepts disclosed herein are directed to a bridge paving machine and method for paving a 3D design without vertical profile rails. The bridge paving machine converts a desired design into a 3D surface model to account for certain factors known to cause deviations in the paving processes.

In a further aspect, an on-board computer system may adjust the 3D surface model in real-time to correct for on-site variables and measured deflections of beams in the superstructure. The on-board computer system receives data from various external sensors and paving machine-based sensors, and uses various predictive models to predict surface deflection based on the sensor data. The 3D surface model is continuously updated based on the predictive models and actual measured deflections.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1:
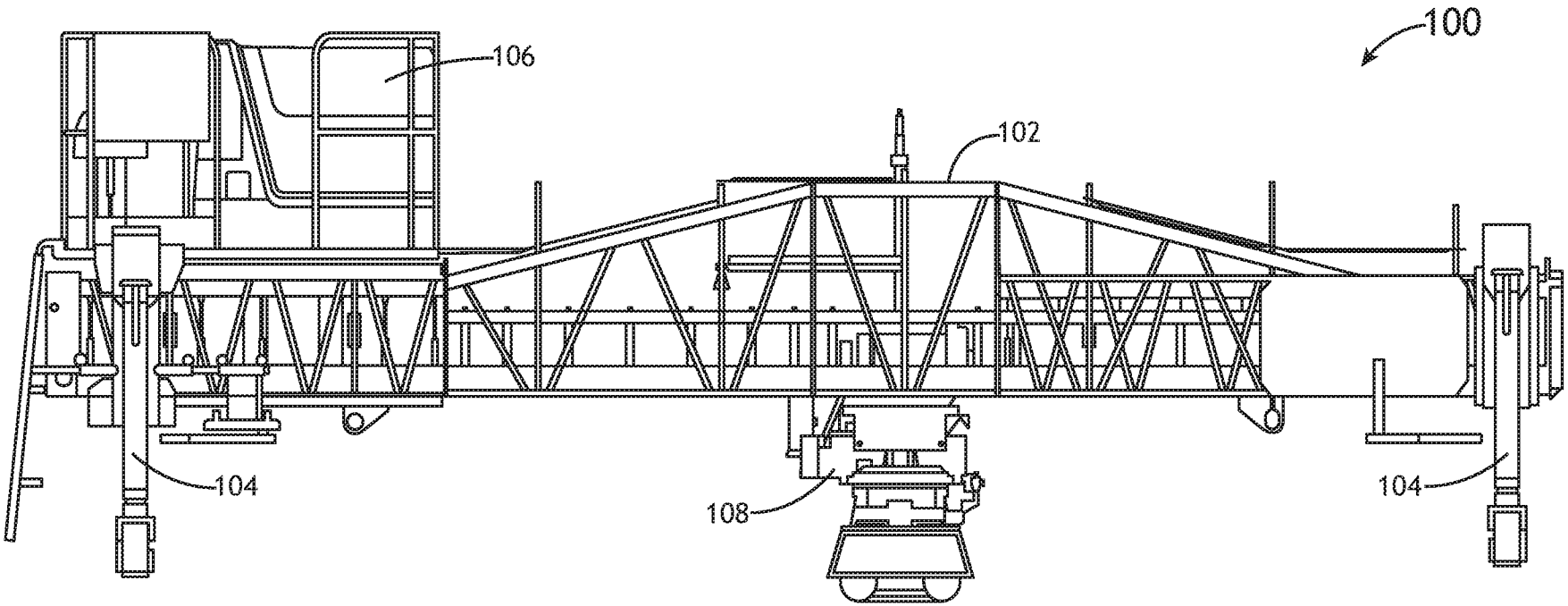
FIG. 1 shows a front view of an exemplary embodiment of a bridge paving machine according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

The specific teachings of this disclosure may be better understood with reference to bridge paving machines and finishing machines as described in U.S. Pat. No. 9,739,019 (issued Aug. 22, 2017) and U.S. Pat. No. 9,670,627 (issued Jun. 6, 2017).

Broadly, embodiments of the inventive concepts disclosed herein are directed to a bridge paving machine and method for paving a 3D design without vertical profile rails. The bridge paving machine converts a desired design into a 3D surface model to account for certain factors known to cause deviations in the paving processes. An on-board computer system may adjust the 3D surface model in real-time to correct for on-site variables and measured deflections of beams in the superstructure. The on-board computer system receives data from various external sensors and paving machine-based sensors, and uses various predictive models to predict surface deflection based on the sensor data. The 3D surface model is continuously updated based on the predictive models and actual measured deflections.

Referring to FIG. 1, a front view of an exemplary embodiment of a bridge paving machine 100 according to the inventive concepts disclosed herein is shown. The bridge paving machine 100 includes a superstructure 102 supported by a plurality of tracks 104 for moving the bridge paving machine 100 along a span to be paved. The bridge paving machine 100 is powered and controlled by a control unit 106 that may include one or more processing elements and data communication elements for receiving external data to determine surface deflection of the paved surface during paving.

The bridge paving machine 100 also includes a carriage 108 that supports various paving/finishing tools such as a cylinder finisher that transits the span of the superstructure 102 during the paving process. The carriage 108 either includes or is connected to the superstructure 102 via hydraulics or other linear actuating elements to move the carriage 108 closer to or further from the superstructure 102 at various points along the span according to the 3D surface model. The carriage 108 may include features for paving, finishing, and analyzing the paved surface. Data from the carriage 108 and deflection sensors on individual structural beams of the bridge may be used to analyze deflections in the paved surface during the paving process to update the 3D surface model going forward.

Figure 2C:
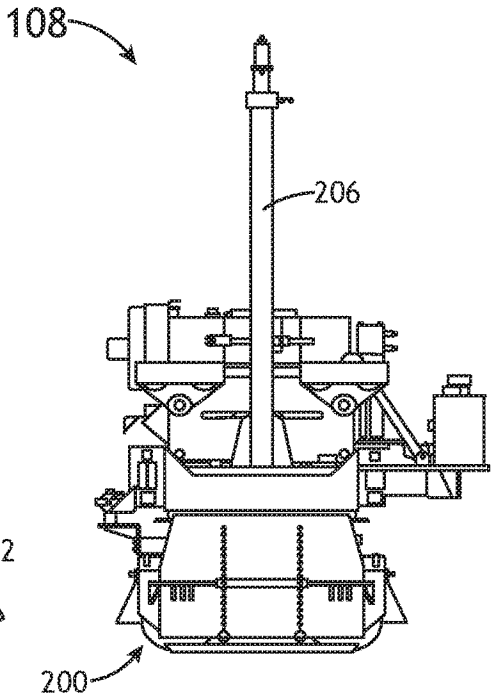
FIG. 2C shows a side view of an exemplary embodiment of a carriage according to the inventive concepts disclosed herein.
Figure 2B:
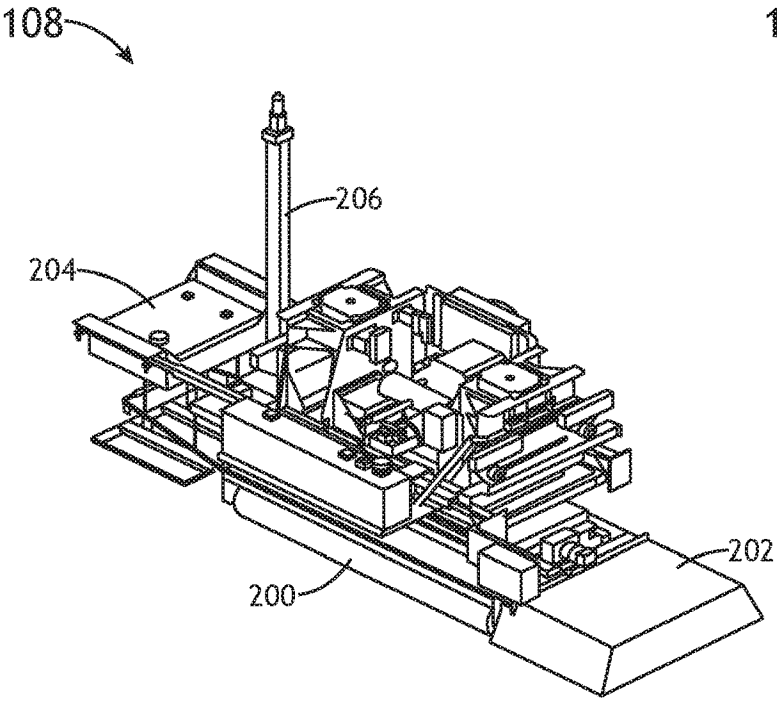
FIG. 2B shows a perspective view of an exemplary embodiment of a carriage according to the inventive concepts disclosed herein.
Figure 2A:
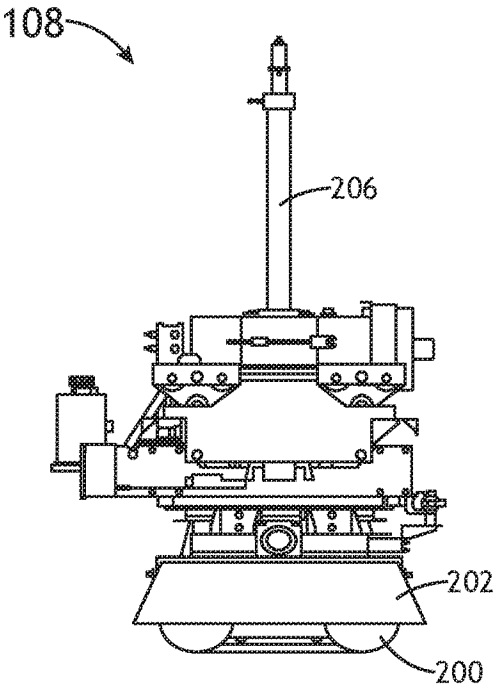
FIG. 2A shows a side view of an exemplary embodiment of a carriage according to the inventive concepts disclosed herein.

Referring to FIGS. 2A-2C, views of an exemplary embodiment of a carriage 108 according to the inventive concepts disclosed herein are shown. The carriage 108 may be configured to engage a bridge paving machine superstructure, and move linearly along the span of the superstructure as well as vertically to apply a crown to a paved surface. The carriage 108 may comprise a paving/finishing tool 200 such as a cylinder finisher or other accessory element useful during a bridge paving process.

In at least one embodiment, the carriage 108 includes a forward sensor platform 202 disposed on a surface of the carriage 108 in the direction of a paving process. In at least one embodiment, the carriage 108 includes a rear sensor platform 204 disposed on a surface of the carriage 108 opposite the direction of the paving process. In at least one embodiment, the carriage 108 includes a mast 206 which may support a tracking device such as a laser target or total station target, or other device for precisely locating the carriage 108 in 3D space.

The forward sensor platform 202 and rear sensor platform 204 may each include non-contact sensors such as sonic/ultrasonic sensors or laser sensors for precisely measuring distances in front of the carriage 108 and behind the carriage 108. The sensors may also include image capture devices and/or temperature sensors for logging the ambient temperature and the temperature of the paving material. Furthermore, the sensors may include slope sensors.

It may be appreciated that the sensors in the forward sensor platform 202 may be configured to determine the location of support structures such as reinforcing elements before they are completely obscured by paving material. Alternatively, or in addition, the sensors may be configured to map the underlying reinforcing elements via ultrasonic differentiation after the paving material placed but not yet finished.

In at least one embodiment, the data collected from the sensors in the forwards sensor platform 202 and rear sensor platform 204 are correlated to the location determined via the mast 206 and transferred to a pacing processor which may be housed in a control unit or remotely. The data is further correlated to beam deflection data received from beam deflection sensors attached to structural beams or girders of the bridge.

Figure 3:
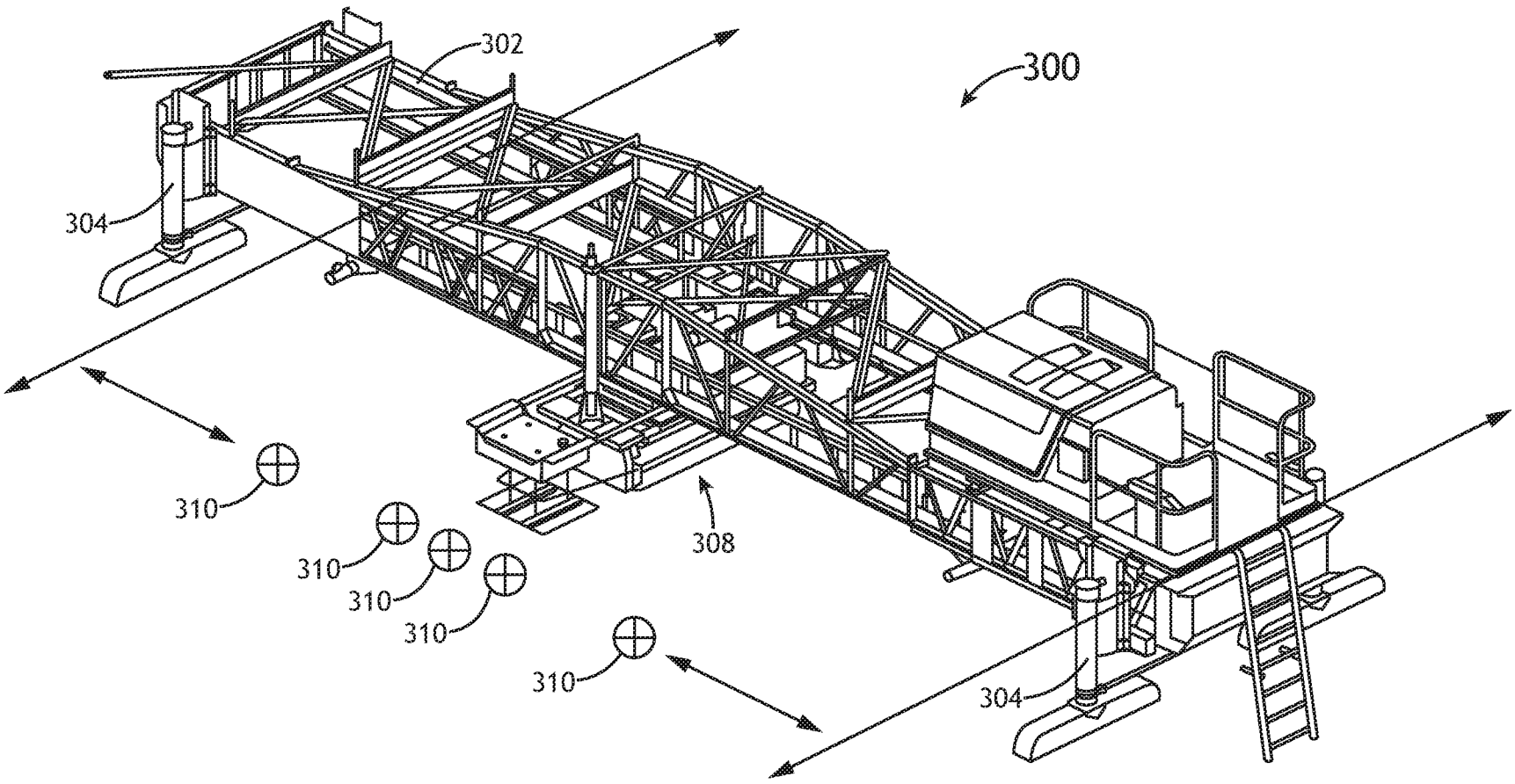
FIG. 3 shows a perspective view of an exemplary embodiment of a bridge paving machine according to the inventive concepts disclosed herein.

Referring to FIG. 3, a perspective view of an exemplary embodiment of a bridge paving machine 300 according to the inventive concepts disclosed herein is shown. The bridge paving machine 300 includes a superstructure 302 supported on a plurality of tracks 304, a control unit 306, and a carriage 308 including a forward sensor platform and a rear sensor platform.

The sensors of the forward sensor platform and rear sensor platform may be configured to analyze specific points 310 along a paving surface. Those specific points 310 may be identified to correspond to certain measurable deflections in the bridge structure due to paving; such measurable deflections measured via sensors affixed to underlying beams or girders and the specific points 310. Measurements taken at such specific points 310 before and after paving may be compared to predefined models of bridge deck deflection to determine if the actual deflection is conforming to the predefined models. Measurements taken by the forward sensor platform and rear sensor platform may include environmental measurements that may relate to the measured deflection, but which were only estimated at the time an original 3D surface model was calculated; for example, ambient or material temperature, dynamic loads such as wind, etc.

Figure 4:
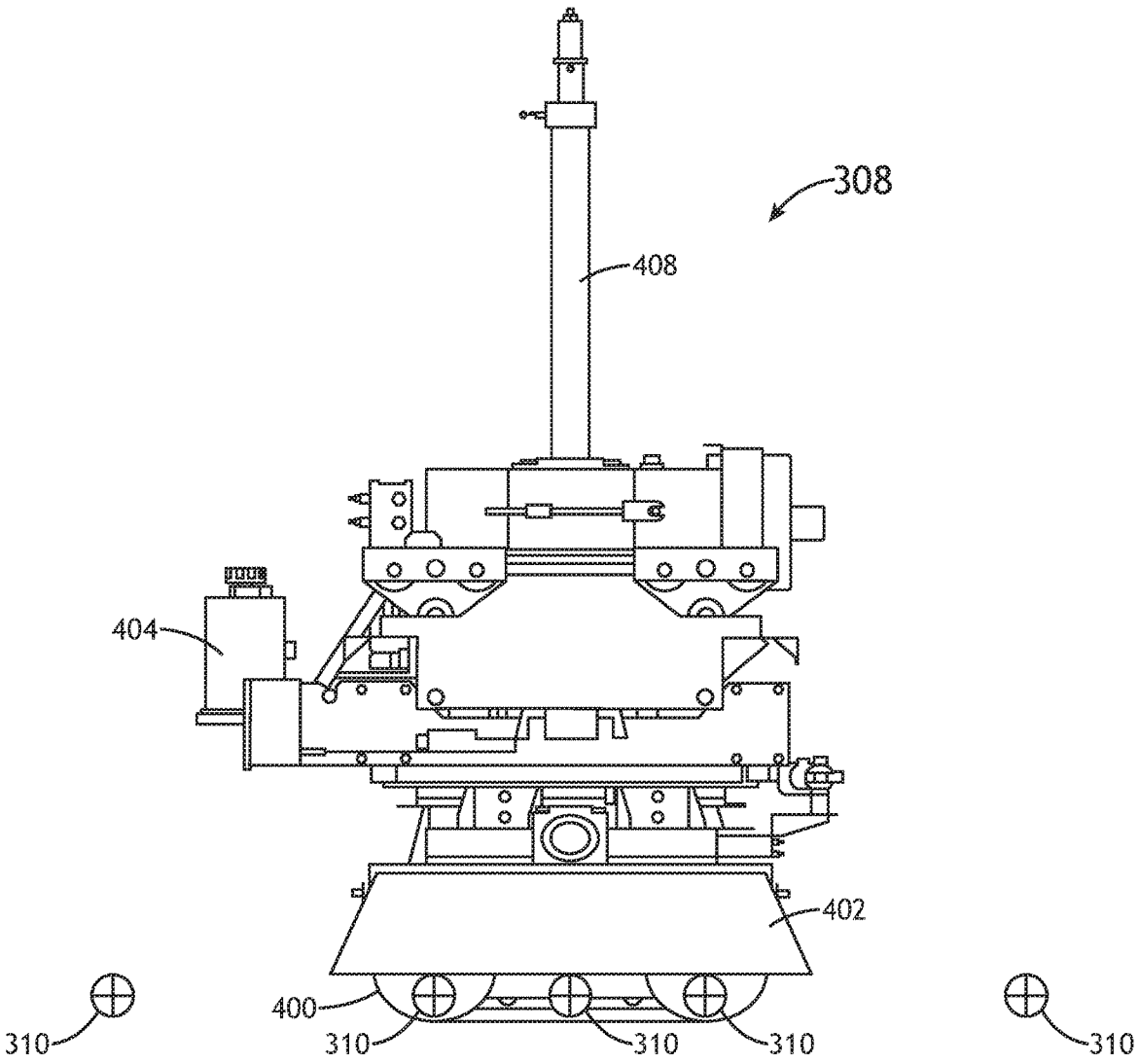
FIG. 4 shows a side view of an exemplary embodiment of a carriage according to the inventive concepts disclosed herein.

Referring to FIG. 4, a side view of an exemplary embodiment of a carriage 308 according to the inventive concepts disclosed herein is shown. The carriage 308 includes a forward sensor platform 402 and a lateral sensor platform 404 disposed on a surface of the carriage 308 corresponding the direction of the lateral movement of the carriage 308 during a paving process. In at least one embodiment, the carriage 308 includes a mast 406 with a tracking device for precisely locating the carriage 308 in 3D space.

The forward sensor platform 402 and lateral sensor platform 404 may each include non-contact sensors such as sonic/ultrasonic sensors or laser sensors for precisely measuring certain specific points 310 corresponding to deflection sensors affixed to underlying beams or girders in the paving surface and various environmental factors related to those specific points 310. In at least one embodiment, the specific points 310 are analyzed for vertical deviations in the aggregate (all of the specific points showing some deflection) and individually indicating some deflection that varies laterally. In at least one embodiment, the specific points 310 may correspond to individually identifiable features such that the sensors may identify lateral deviation at the specific points 310 during the paving process.

Figure 5A:
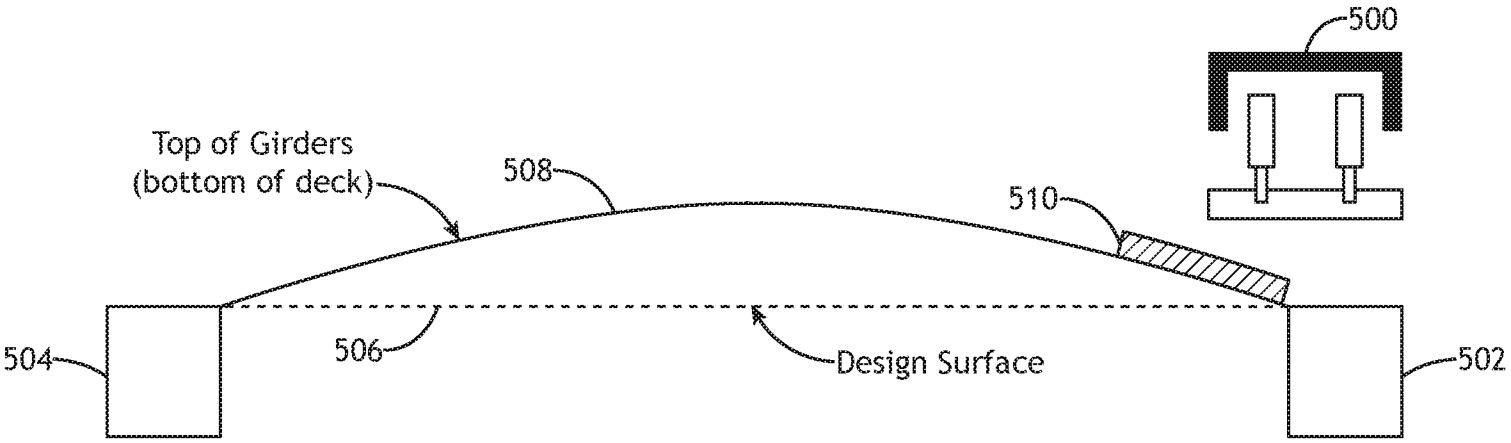
FIG. 5A shows a block representation of a bridge at the beginning of a paving process.
Figure 5B:
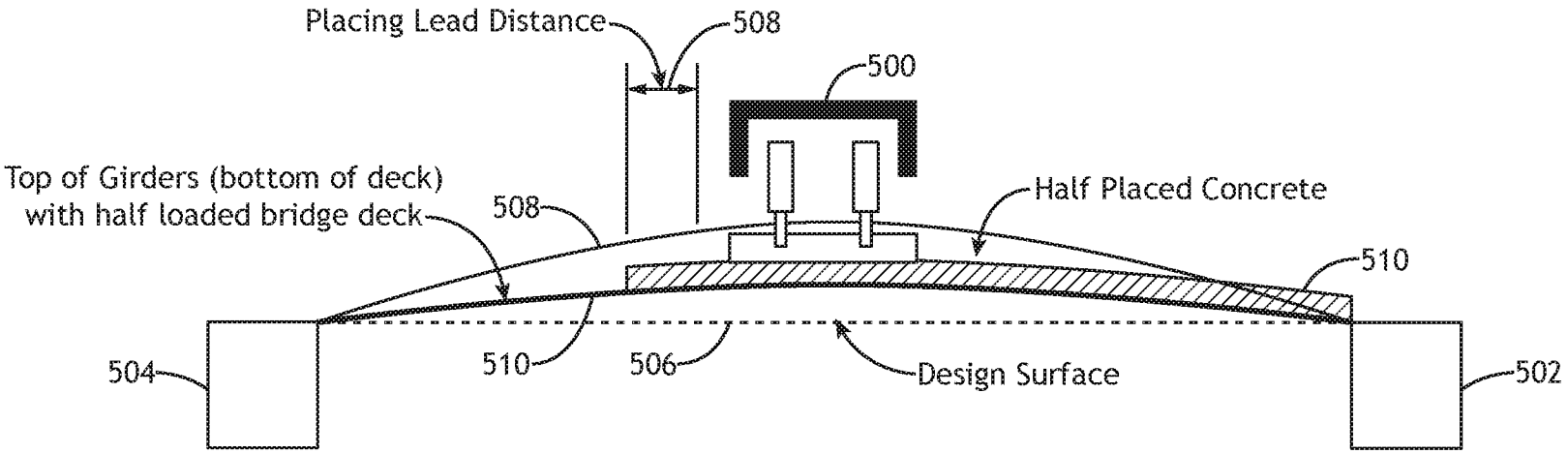
FIG. 5B shows a block representation of a bridge during a paving process.
Figure 5C:
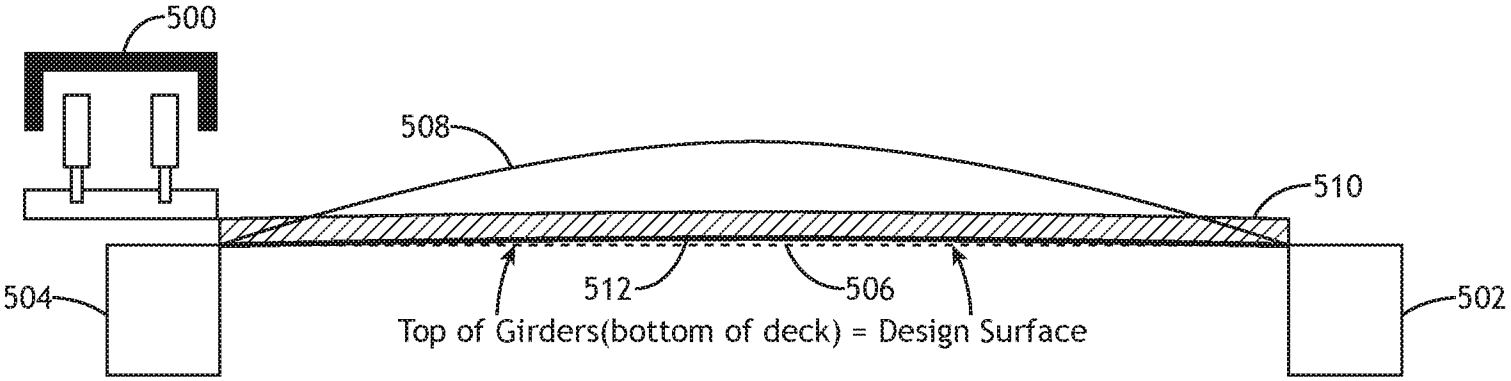
FIG. 5C shows a block representation of a bridge at the end of a paving process.

Referring to FIGS. 5A-5C, block representations of a bridge during a paving process are shown. Prior to the beginning of a paving process from a starting location 502 to an ending location 504, a bridge paving machine 500 or external computer system receives or determines a design surface 506 corresponding to an ideal final paved surfaced. During the initial setup, (as in FIG. 5A), certain factors may impact the deflection of the paved surface during paving. For example, the deflection of the paved surface may be impacted by span, girder camber, dead loads, live loads (the impact of the bridge paving machine itself, etc.), dynamic loading, and expected environmental factors (ambient temperature and pressure, concrete temperature, girder temperature, etc.), or other predefined factors. Such factors may be related to the deflection of the paving surface by one or more engineering models. Those factors and engineering models are used to define a 3D surface model corresponding to the top of the supporting girders 508 as they deflect over the course of the paving process, and the actual placement of the paving surface 510 during the paving process such that the finished surface will be brought into conformity with the design surface 506. The bridge paving machine 500 may then begin placing the paving surface 510 along the 3D surface model.

During the paving process (as in FIG. 5B), the paving surface 510 deflects the underlying girders, presumably along from the 3D surface model, to an actual surface 512 due to the weight of the paving surface 510 compressing and deflecting the supporting girders according to the factors previously described. Because the original determination of the 3D surface model was based on certain engineering models and assumptions based on an average lead distance 514, there is a probability that the deflection caused by the paving surface 510 does not conform to the expected deflection, either because the assumptions were inaccurate, the models were inaccurate, or certain of the factors changed over time. Sensors disposed at known points on the girders measure the actual deflection. Actual deflection is compared with the expected deflection to determine a correction to adjust the deflection going forward. In at least one embodiment, such correction comprises calculating a new 3D surface model going forward based on the measured deflection and recorded environmental factors. In at least one embodiment, such correction comprises modifying the thickness of the paving surface 510 to adjust the weight going forward.

The final paving surface 510 and supporting girder configuration 512 (as in FIG. 5C) may be a close approximation of the design surface 506. The 3D surface model may include an acceptable margin of error for deviation.

Figure 6:
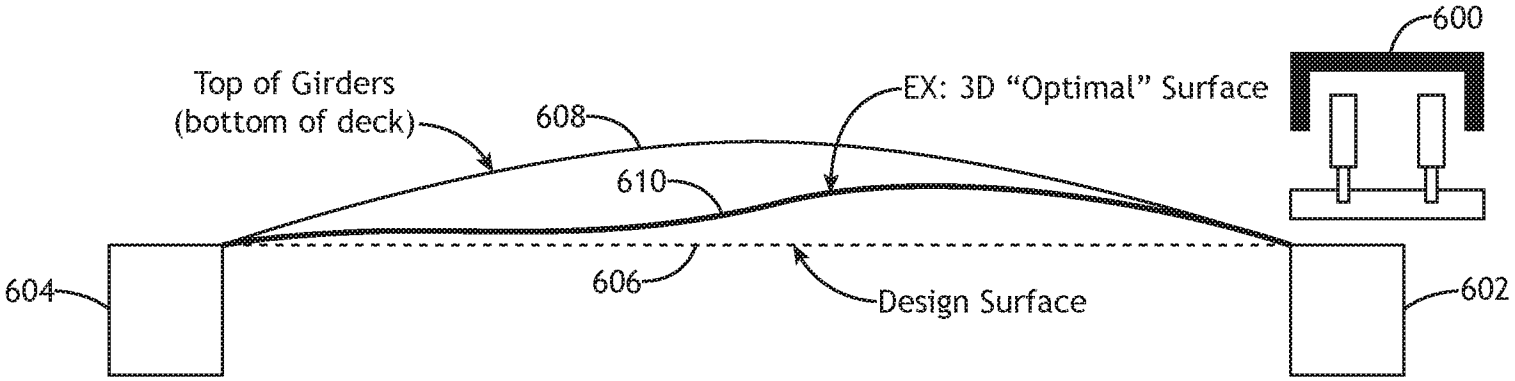
FIG. 6 shows a block representation of an initial phase of a paving process according to an exemplary embodiment of the inventive concepts disclosed herein.

Referring to FIG. 6, a block representation of an initial phase of a paving process such as in FIGS. 5A-5C according to an exemplary embodiment of the inventive concepts disclosed herein is shown. Prior to the beginning of a paving process from a starting location 602 to an ending location 604, a bridge paving machine 600 or external computer system receives or determines a design surface 606 corresponding to an ideal final paved surfaced. The bridge paving machine 600 or external computer system also receives one or more sets of data corresponding to factors that impact the deflection of the paved surface during paving. For example, the deflection of the paved surface may be impacted by span, girder camber, dead loads, live loads (the impact of the bridge paving machine itself, etc.), dynamic loading, and expected environmental factors (ambient temperature and pressure, concrete temperature, girder temperature, etc.), or other predefined factors. Such factors may be related to the deflection of the paving surface by one or more engineering models. Those factors and engineering models are used to define a 3D model surface 610 corresponding to the actual placement of the paving surface during the paving process along top supporting girders 608 such that the finished surface will be brought into conformity with the design surface 606. The bridge paving machine 600 may then begin placing the paving surface along the 3D model surface and continuously monitoring paving surface during the paving process.

During the paving process, the paving surface deflects the supporting girders 608 from the 3D model surface 610 due to the weight of the paving surface according to the factors previously described. Because the original determination of the 3D model surface 610 was based on certain engineering models and assumptions, there is a probability that the deflection caused by the paving surface does not conform to the expected deflection, either because the assumptions were inaccurate, the models were inaccurate, or certain of the factors changed over time. External sensors, such as sensors affixed to the supporting girders 608 at known points to measure deflection, and sensor disposed on the paving machine 600 may measure the deflection of the supporting girders 608. A processor then compares the measured deflection to an expected deflection based on the original assumptions and engineering models.

In at least one embodiment, the processor may alter certain aspects of the paving machine 600 such as the relative height of a carriage above the design surface, the relative height of a crown applied to the paving surface, the relative total height of the paving machine 600 above the design surface, etc. to adjust the 3D models surface 610 going forward to account for the compared deviation.

Alternatively, or in addition, the processor may use the collected sensor data to re-compute the 3D model surface 610 based on the collected sensor data rather than assumed or estimated data originally used.

By continuously monitoring sensor data with respect an average lead distance 614, the paving surface is kept in general conformity with the 3D model surface 610 such that the final paving surface conforms with the original design surface 606 within a defined safety factor or margin of error.

During a paving process, a system of external total stations, reflectors, and other related systems for establishing the position of a bridge paving machine in 3D space may be utilized to determine a deflection of the bridge paving machine during paving for a comparison with an expected deflection. Furthermore, the bridge being paved may also include a plurality of sensors disposed at various locations, such as locations along the supporting girders and/or on any support masts, to provide data to a bridge paving machine during a paving process to update the 3D model surface referenced during the paving process. The sensors may include anemometers, accelerometers, thermometers and thermocouples, strain gauges, global positioning system (GPS) antennas, tiltmeters, buffer sensors, bearing sensors, electro-magnetic sensors, barometers, hygrometers, corrosion sensors, cameras, and dynamic weight-in-motion stations.

Figure 7:
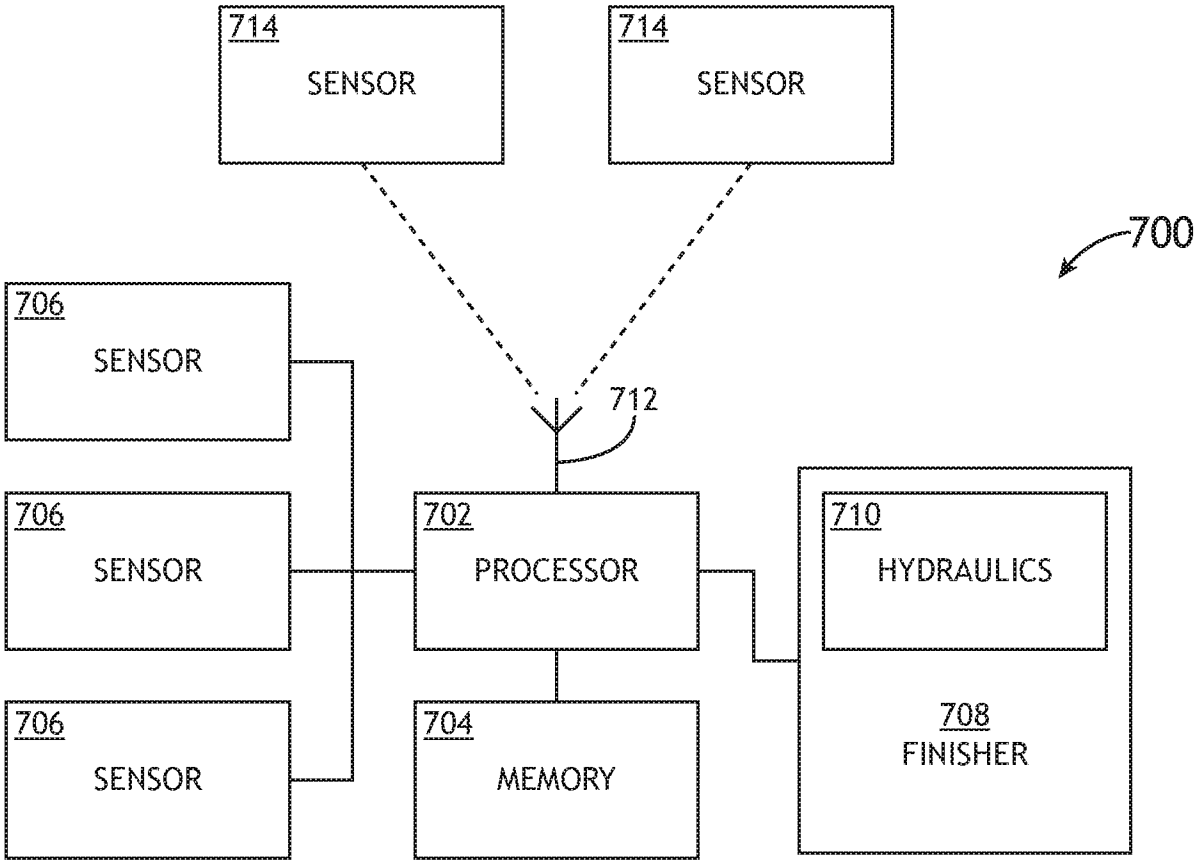
FIG. 7 shows a block diagram of a system for implementing embodiments of the inventive concepts disclosed herein.

Referring to FIG. 7, a block diagram of a system 700 useful for implementing exemplary embodiments is shown. The system 700, generally embodied in a bridge paving system but also implementable externally to the bridge paving system, includes a processor 702 and a memory 704 embodying processor executable code for configuring the processor 702 to monitor data from a plurality of sensors 706 to identify paving surface deflection during a paving process. The processor either determines a likely deflection prior to paving, or receives such a likely deflection, and continuously compares the determined likely value to actual measured values. The processor 702 calculates an adjustment to a 3D model surface corresponding to an actual finished surfaced. During a paving process, the processor 702 adjusts certain aspects of the bridge paving machine such as the position of a finisher 708 and the hydraulics 710 operating the finisher, so that the produced surface, when the paving process is finished, conforms to the original design surface.

A plurality of deflection sensors 714 are disposed at known locations of supporting girders to measure actual deflection during a paving process in real-time. The deflection sensors 714 continuously communicate deflection data with the processor 702.

Figure 8:
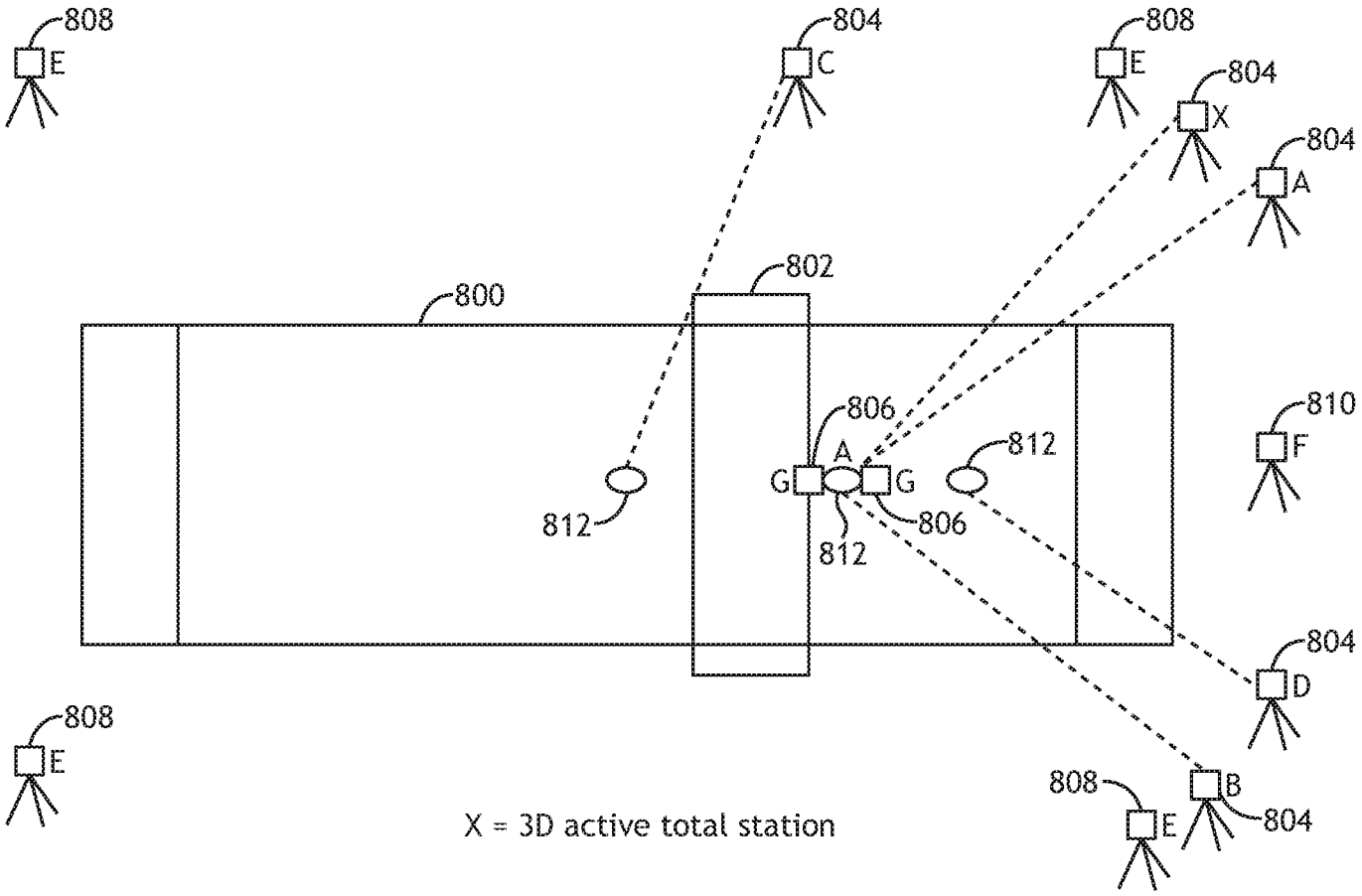
FIG. 8 shows a block diagram of a bridge paving machine according an exemplary embodiment of the inventive concepts disclosed herein.

Referring to FIG. 8, a block diagram of a bridge paving machine 800 according an exemplary embodiment of the inventive concepts disclosed herein is shown. The paving machine 800 includes a carriage 802 having a paving accessory and one or more 3D sensors 806 such as non-contact sensors, cameras, etc. The paving machine 800 also includes one or more locating elements 812 (such as laser reflectors) configured to work in conjunction with one or more total stations 804 or other laser locating devices to provide a precise location of the paving machine 800 and carriage 802 in 3D space.

In at least one embodiment, a system utilizing such a paving machine 800 may also include external elements such one or more static cameras 808, one or more video cameras 810, one or more total stations 804, girder mounted deflection sensors, and data communication elements that may allow data from one or more CAN connected sensors, Ethernet connected sensors, Bluetooth connected sensor, Wi-Fi connected sensors, etc.

Figure 9:
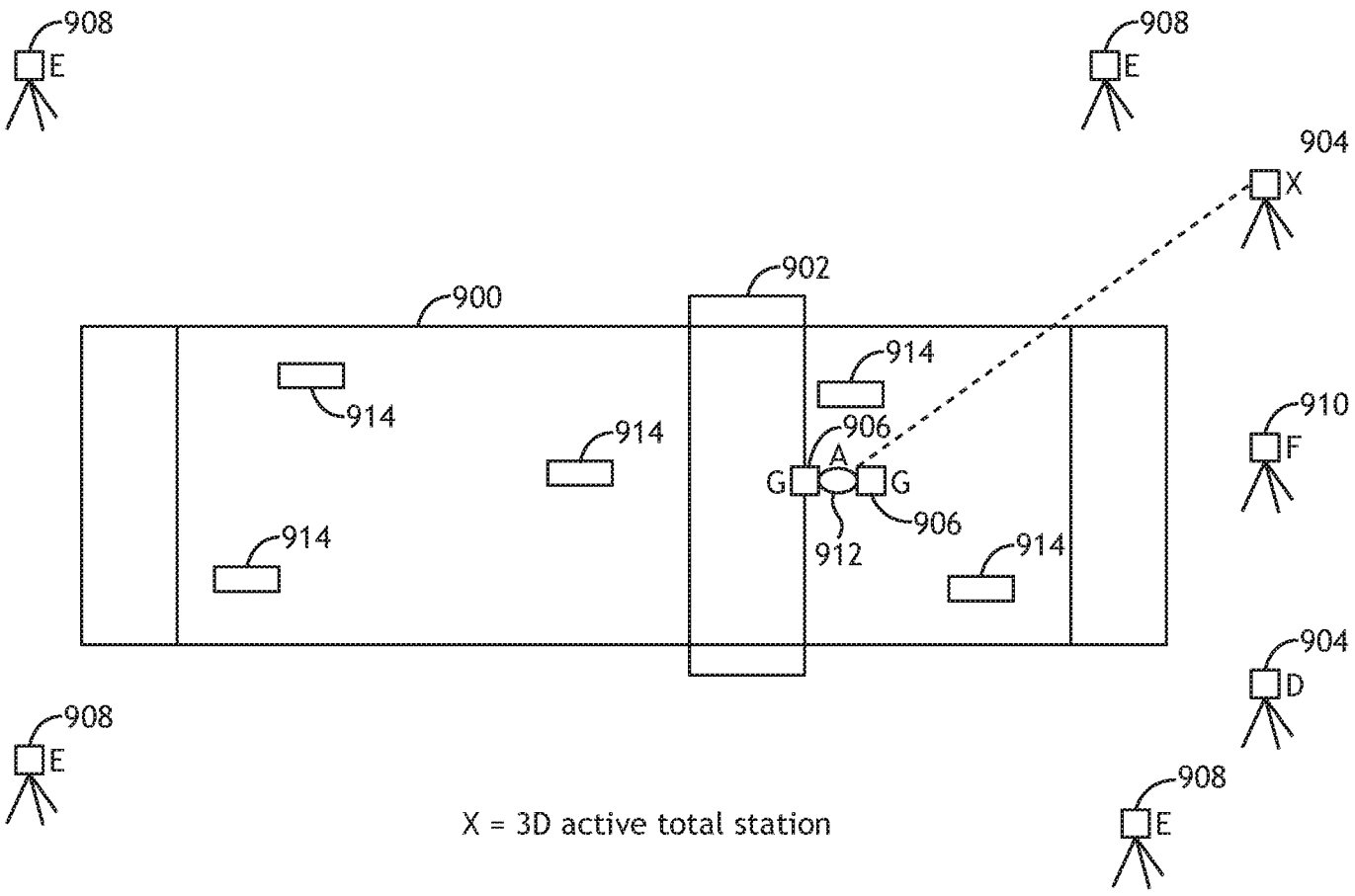
FIG. 9 shows a block diagram of a bridge paving machine according an exemplary embodiment of the inventive concepts disclosed herein.

Referring to FIG. 9, a block diagram of a bridge paving machine according an exemplary embodiment of the inventive concepts disclosed herein is shown. The paving machine 900 includes a carriage 902 having a paving accessory and one or more 3D sensors 906 such as non-contact sensors, cameras, etc. The paving machine 900 also includes one or more locating elements 912 (such as laser reflectors) configured to work in conjunction with one or more total stations 904 or other laser locating devices to provide a precise location of the paving machine 900 and carriage 902 in 3D space. The paving machine 900 may also include one or more tilt or slope sensors 914, either specifically dedicated to determining deflection according to embodiments described herein, or as a nominal part of the paving machine 900.

In at least one embodiment, a system utilizing such a paving machine 900 may also include external elements such one or more static cameras 908, one or more video cameras 910, one or more total stations 904, girder mounted deflection sensors, and data communication elements that may allow data from one or more CAN connected sensors.

Figure 10:
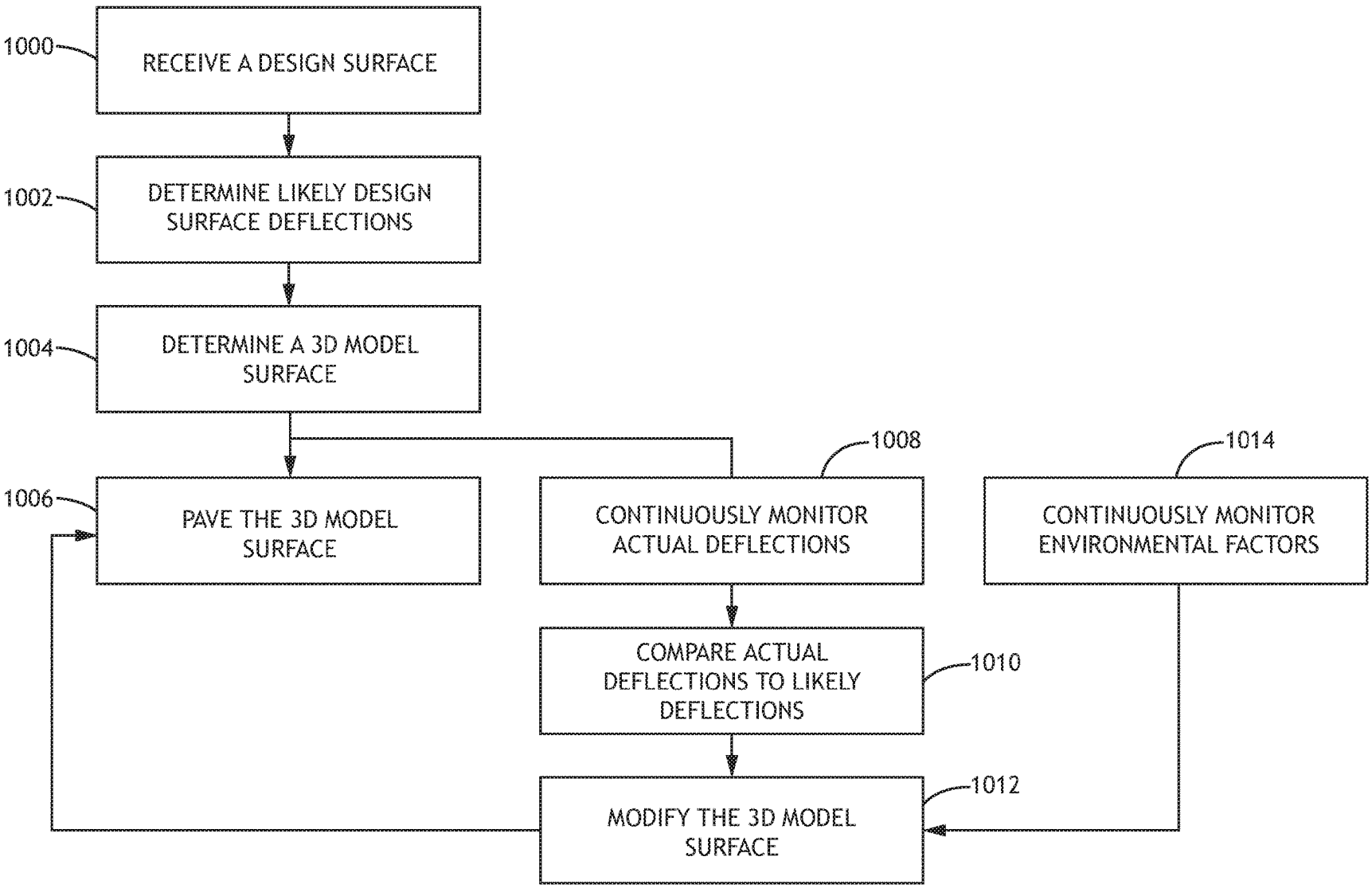
FIG. 10 shows a flowchart of a method for paving according to exemplary embodiments of the inventive concepts disclosed herein.

Referring to FIG. 10, a flowchart of a method for paving according to exemplary embodiments of the inventive concepts disclosed herein is shown. Prior to the paving process, a computer system may receive 1000 a design surface corresponding to a desired, final, paved surface. Based on certain assumed factors of the pre-paved bridge structure, the materials used, the paving machine being used, the ambient characteristics, etc., likely design surface deflections may be determined 1002 corresponding to the vertical deflection of the actual paving surface during paving. A 3D model surface is determined 1004 based on the likely deflection. The 3D model surface may be determined 1004 via differential or integrative algorithms to identify the expected deflection at each point due to the entire weight of the paving surface. A paving machine then begins to pave 1006 the paving surface according to the 3D model surface.

In at least one embodiment, sensors on-board the paving machine and external to the paving machine, such as girder mounted deflection sensors, continuously monitor 1008 actual deflection of the paving surface. The measured deflections are compared 1010 to the expected deflections at each point to identify deviations and the 3D model surface is modified 1012 to accommodate those deviations. In at least one embodiment, on-board and external sensors also continuously monitor 1014 ambient environmental factors and also incorporate those actual measurements to modify 1012 the 3D model surface. The paving machine then paves 1006 the updated 3D model surface.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. A bridge paving machine comprising:
a paving machine superstructure;
a carriage configured to transit the paving machine superstructure comprising:
a finishing tool; and
a plurality of non-contact surface sensors; and
at least one paving processor in data communication with a memory storing processor executable code for configuring the at least one paving processor to:
receive a desired design for a bridge surface;
receive a set of corrections relating one or more structural features of a bridge deck to corresponding deviations in the desired design;
incorporate the set of corrections into a design profile to produce an optimized 3D surface model;
execute the optimized 3D surface model with a bridge paver having a 3D carriage;
capture a plurality of images over time, from defined locations of a bridge frame, synchronized with specific events during the paving process;
analyze the plurality of images to identify a deformation during the paving process;
determine a correction in a later portion of the paving process based on the deformation; and
apply the correction in the later portion of the paving process to the optimized 3D surface model.

2. The bridge paving machine of claim 1, wherein the at least one paving processor is further configured to:
identify a deformation during a paving process;
determine a correction in a later portion of the paving process based on the deformation; and
apply the correction in the later portion of the paving process to the optimized 3D surface model.

3. The bridge paving machine of claim 1, wherein identifying the deformation comprises receiving a plurality of deflection measurements from one or more deflection sensors disposed at known locations on supporting beams of a bridge structure.

4. The bridge paving machine of claim 1, wherein the at least one paving processor is further configured to:
capture a plurality of images over time of a poured surface from behind a paving machine;
analyze the plurality of images to identify a deformation during the paving process;
determine a correction in a later portion of the paving process based on the deformation; and
apply the correction in the later portion of the paving process to the optimized 3D surface model.

5. The bridge paving machine of claim 1, wherein the at least one paving processor is further configured to:
continuously analyze log data from a plurality of controller area network (CAN) connected sensors;
analyze the log data to identify a deformation during the paving process;
determine a correction in a later portion of the paving process based on the deformation; and
apply the correction in the later portion of the paving process to the optimized 3D surface model.

6. The bridge paving machine of claim 1, wherein the at least one paving processor is further configured to:
continuously receive grade data from one or more total stations;
analyze the grade data to identify a deformation during the paving process;
determine a correction in a later portion of the paving process based on the deformation; and
apply the correction in the later portion of the paving process to the optimized 3D surface model.

7. A method comprising:
receiving a desired design for a bridge surface;
receiving a set of corrections relating one or more structural features of a bridge deck to corresponding deviations in the desired design;
incorporating the set of corrections into a design profile to produce an optimized 3D surface model;
executing the optimized 3D surface model with a bridge paver having a 3D carriage;
capturing a plurality of images over time of a poured surface from behind a paving machine;
analyzing the plurality of images to identify a deformation during the paving process;
determining a correction in a later portion of the paving process based on the deformation;
applying the correction in the later portion of the paving process to the optimized 3D surface model; and
continuously receiving deflection measurements from a plurality of deflection sensors disposed at known locations of supporting girders of the bridge deck.

8. The method of claim 7, further comprising:
identifying a deformation during a paving process;
determining a correction in a later portion of the paving process based on the deformation; and
applying the correction in the later portion of the paving process to the optimized 3D surface model.

9. The method of claim 7, further comprising:
capturing a plurality of images over time, from defined location of a bridge frame, synchronized with specific events during the paving process;
analyzing the plurality of images to identify a deformation during the paving process;
determining a correction in a later portion of the paving process based on the deformation; and
applying the correction in the later portion of the paving process to the optimized 3D surface model.

10. The method of claim 7, further comprising:
continuously analyzing log data from a plurality of controller area network (CAN) connected sensors;
analyzing the log data to identify a deformation during the paving process;
determining a correction in a later portion of the paving process based on the deformation; and
applying the correction in the later portion of the paving process to the optimized 3D surface model.

11. The method of claim 7, further comprising:
continuously receiving grade data from one or more total stations;
analyzing the grade data to identify a deformation during the paving process;
determining a correction in a later portion of the paving process based on the deformation; and
applying the correction in the later portion of the paving process to the optimized 3D surface model.

12. A bridge paving system comprising:

a plurality of deflection sensors disposed at known locations on girders of a bridge deck configured to provide deflection data to a bridge paving machine processor;

a paving machine comprising;

a superstructure;

a carriage configured to transit laterally along the superstructure comprising:

a finishing tool; and a plurality of non-contact surface sensors; and at least one paving processor in data communication with a memory storing processor executable code for configuring the at least one paving processor to:

receive a desired design for a bridge surface;

receive a set of corrections relating one or more structural features of a bridge deck to corresponding deviations in the desired design;

incorporate the set of corrections into a design profile to produce an optimized 3D surface model;

execute the optimized 3D surface model;

capture a plurality of images over time of a poured surface from behind the paving machine;

analyze the plurality of images to identify a deformation during a paving process;

determine a correction in a later portion of the paving process based on the deformation; and apply the correction in the later portion of the paving process to the optimized 3D surface model.

13. The bridge paving system of claim 12, further comprising one or more total stations disposed at defined locations on the bridge structure.

14. The bridge paving system of claim 13, wherein the at least one paving processor is further configured to:

continuously receive data from the one or more total stations;

analyze the data to identify a deformation during the paving process;

determine a correction in a later portion of the paving process based on the deformation; and apply the correction in the later portion of the paving process to the optimized 3D surface model.

15. The bridge paving system of claim 12, wherein the plurality of non-contact sensors comprises:

at least one non-touch sensor disposed on a front surface of the paving machine configured to collect data about a deck before paving; and at least one non-touch sensor disposed on a rear surface of the paving machine configured to collect data about a finished surface.

16. The bridge paving system of claim 15, wherein the at least one paving processor is further configured to:

continuously receive data from the at least one non-touch sensor disposed on the front surface and the at least one no-touch sensor disposed on the rear surface;

analyze the data to identify a deformation during the paving process;

determine a correction in a later portion of the paving process based on the deformation; and apply the correction in the later portion of the paving process to the optimized 3D surface model.

17. The bridge paving system of claim 12, wherein the paving machine further comprises one or more slope sensors.

18. The bridge paving system of claim 17, wherein the at least one paving processor is further configured to:

continuously receive data from the one or more slope sensors;

analyze the data to identify a deformation during the paving process;

determine a correction in a later portion of the paving process based on the deformation; and apply the correction in the later portion of the paving process to the optimized 3D surface model.

* * * * *